US006094872A

United States Patent [19]

Ward et al.

[11] Patent Number: 6,094,872

[45] Date of Patent: Aug. 1, 2000

[54] PARTITION AND FLOOR CHANNEL CONSTRUCTION

[75] Inventors: David E. Ward, Alto; Steven J. Throndset, Kentwood; Robert W. Corl, III, Grand Rapids; Robert E. Jeffers, Ada, all of Mich.

[73] Assignee: Steelcase Development Inc., Grand Rapids, Mich.

[21] Appl. No.: 09/415,397

[22] Filed: Oct. 8, 1999

[51] Int. Cl.[7] ..... E04B 2/82

[52] U.S. Cl. ..... 52/126.4; 52/241; 52/238.1

[58] Field of Search ..... 52/36.1, 122.1, 52/126.1, 126.2, 126.3, 126.4, 126.7, 238.1, 239

[56] References Cited

U.S. PATENT DOCUMENTS

| | | | |
|---|---|---|---|
| 2,040,385 | 5/1936 | Kellogg . | |
| 2,235,761 | 3/1941 | Goldsmith . | |
| 2,763,342 | 9/1956 | French | 52/126.7 |
| 2,812,834 | 11/1957 | Jeune | 52/126.7 |
| 2,915,151 | 12/1959 | Kekenak . | |
| 2,968,374 | 1/1961 | Bohnsack . | |
| 3,083,795 | 4/1963 | Land . | |
| 3,332,182 | 7/1967 | Mark . | |
| 3,408,781 | 11/1968 | Pollock . | |
| 3,453,790 | 7/1969 | Harris . | |
| 3,638,376 | 2/1972 | Howes et al. . | |
| 3,638,387 | 2/1972 | Lickliter et al. . | |
| 3,696,569 | 10/1972 | Didry | 52/126.4 |
| 3,837,128 | 9/1974 | O'Brien . | |
| 3,885,361 | 5/1975 | De Schutter | 52/126.4 |
| 3,894,377 | 7/1975 | Welch . | |
| 3,989,399 | 11/1976 | Slowbe . | |
| 4,086,734 | 5/1978 | Hayashi | 52/126.4 |
| 4,277,920 | 7/1981 | Dixon . | |
| 4,407,101 | 10/1983 | Propst et al. . | |
| 4,449,337 | 5/1984 | Gzym | 52/126.4 |
| 4,555,880 | 12/1985 | Gzym | 52/126.4 |
| 4,631,894 | 12/1986 | Jerila . | |
| 4,783,034 | 11/1988 | Ostrander et al. . | |
| 4,833,848 | 5/1989 | Guerin | 52/238.1 |
| 4,914,880 | 4/1990 | Albertini . | |
| 5,155,955 | 10/1992 | Ball et al. . | |
| 5,274,970 | 1/1994 | Roberts | 52/126.4 |
| 5,313,752 | 5/1994 | Hatzinikolas . | |
| 5,746,035 | 5/1998 | Seiber | 52/238.1 |
| 5,809,714 | 9/1998 | Kurrasch | 52/239 |
| 5,836,121 | 11/1998 | Hofman | 52/126.4 |
| 5,899,036 | 5/1999 | Seiber | 52/126.4 |

*Primary Examiner*—Carl D. Friedman
*Assistant Examiner*—Kevin McDermott
*Attorney, Agent, or Firm*—Price, Heneveld, Cooper, DeWitt and Litton

[57] ABSTRACT

An apparatus is provided that includes a floor channel having a floor-engaging flange and a raised flange with an aperture. A partition has a leveler assembly including a threaded leveling glide that can be rotated for adjusting the height of the partition relative to a floor surface. The leveling glide includes a shaft that extends through the aperture and further includes a head positioned below the raised flange that is larger than the aperture so that the head cannot be pulled through the aperture. The leveling glide also includes an upper end section positioned above the floor channel, and each of the head, the shaft, and the upper end section have non-circular cross sections shaped so that they can be engaged by tools to rotate and adjust the leveling glide. Also provided is a method of (a) providing a floor channel having a floor-engaging flange and a raised flange with an aperture, (b) providing a partition having a leveler assembly that includes a threaded leveling glide with a shaft extended through the aperture, a head positioned below the raised flange that is larger than the aperture, and an upper end section positioned above the floor channel where the shaft, the head, and the upper end section are each shaped so for engagement by a tool, and (c) selectively engaging one of the shaft, the head, or the upper end section of the leveling glide with a tool to rotationally adjust the height of the partition relative to the floor surface.

24 Claims, 2 Drawing Sheets

PARTITION AND FLOOR CHANNEL CONSTRUCTION

BACKGROUND OF THE INVENTION

The present invention relates to systems for connecting a partition panel to a floor channel, and more particularly to a leveling device for a partition system and connection thereof to a floor channel.

Modern office partition systems are often adapted to meet local, state, and federal statutes or regulations regarding stability and safety, especially with regard to catastrophic events. An example of such a statute relates to a connecting system for securing a partition to a floor channel to prevent undesired movement of the partition system during an earthquake, violent storm, or other catastrophic event.

At least one system exists to address such statutes and regulations and is disclosed in U.S. Pat. No. 5,836,121. That system uses a groove in the bottom of a cylindrically-shaped leveling glide that fits into a key hole and is held into place with a spring clip. Although such a product meets all standards under the above-noted statute, under extreme seismic activity or other shock, the spring clip may jar loose or the flanges in the keyhole may bend and "open up," thus affecting the stability of the partition system.

Accordingly, a system for connection of a partition to a floor channel, including a leveling device, is sought that provides ease of installation while providing increased stability in the event of a catastrophic event, for example an earthquake.

SUMMARY OF THE INVENTION

In one aspect of the present invention, an apparatus includes a floor channel having a floor-engaging flange and a raised flange with an aperture. A partition has a leveler assembly that includes a threaded leveling glide that can be rotated for adjusting the height of the partition relative to a floor surface. The leveling glide includes a shaft that extends through the aperture and further includes a head positioned below the raised flange that is larger than the aperture so that the head cannot be pulled through the aperture. The leveling glide also includes an upper end section positioned above the floor channel, and each of the head, the shaft, and the upper end section have non-circular cross sections shaped so that they can be engaged by tools to rotate and adjust the leveling glide. In a narrower aspect, the aperture in the raised flange is circular in shape for optimal distribution of stress.

In another aspect of the present invention, an apparatus includes a floor channel having a floor-engaging flange and having a raised flange with an aperture. The apparatus also includes a partition having a leveler assembly that includes a leveling glide that can be adjusted to change the height of the partition relative to a floor surface. The leveling glide has a shaft that extends through the aperture and also includes a head positioned below the raised flange that is larger than the aperture so that the head cannot be pulled through the aperture. The apparatus further includes a clip attached to the floor channel below the raised flange with a retainer section that abuts the head and prevents the head from dropping below the floor-engaging flange.

In still another aspect of the present invention, a method comprises the steps of (a) providing a floor channel having a floor-engaging flange and a raised flange with an aperture, (b) providing a partition having a leveler assembly that includes a threaded leveling glide where the glide includes a shaft extended through the aperture, a head positioned below the raised flange that is larger than the aperture so that the head cannot be pulled through the aperture, and including an upper end section positioned above the floor channel where the shaft, the head, and the upper end section each has a cross section shaped to be engaged by a tool for rotationally adjusting the leveling glide, and (c) selectively engaging one of the shaft, the head, or the upper end section of the leveling glide with a tool to adjust the height of the partition relative to the floor surface.

These and other features and advantages of the present invention will be further understood and appreciated by those skilled in the art by reference to the following specification, claims and appended drawings.

DETAILED DESCRIPTION OF PREFERRED EMBODIMENT

Figure 3:
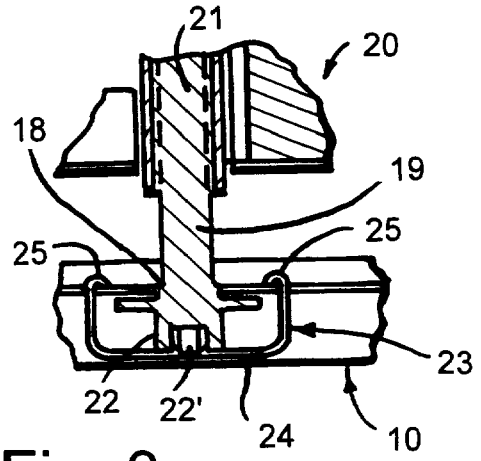
FIG. 3 is a fragmentary cross sectional front view of the present invention taken along line III—III in FIG. 2.

For purposes of description herein, the terms "upper," "lower," "right," "left," "rear," "front," "vertical," "horizontal," and derivatives thereof shall relate to the invention as oriented in FIG. 3, the front of the partition frame facing out from the printed page. However, it is to be understood that the invention may assume various alternative orientations, except where expressly specified to the contrary. It is also to be understood that the specific devices and processes illustrated in the attached drawings, and described in the following description, are simply exemplary embodiments of the inventive concepts defined in the appended claims. Hence, specific dimensions of other physical characteristics relating to the embodiments disclosed herein are not to be considered as limiting, unless the claims expressly state otherwise.

Figure 1:
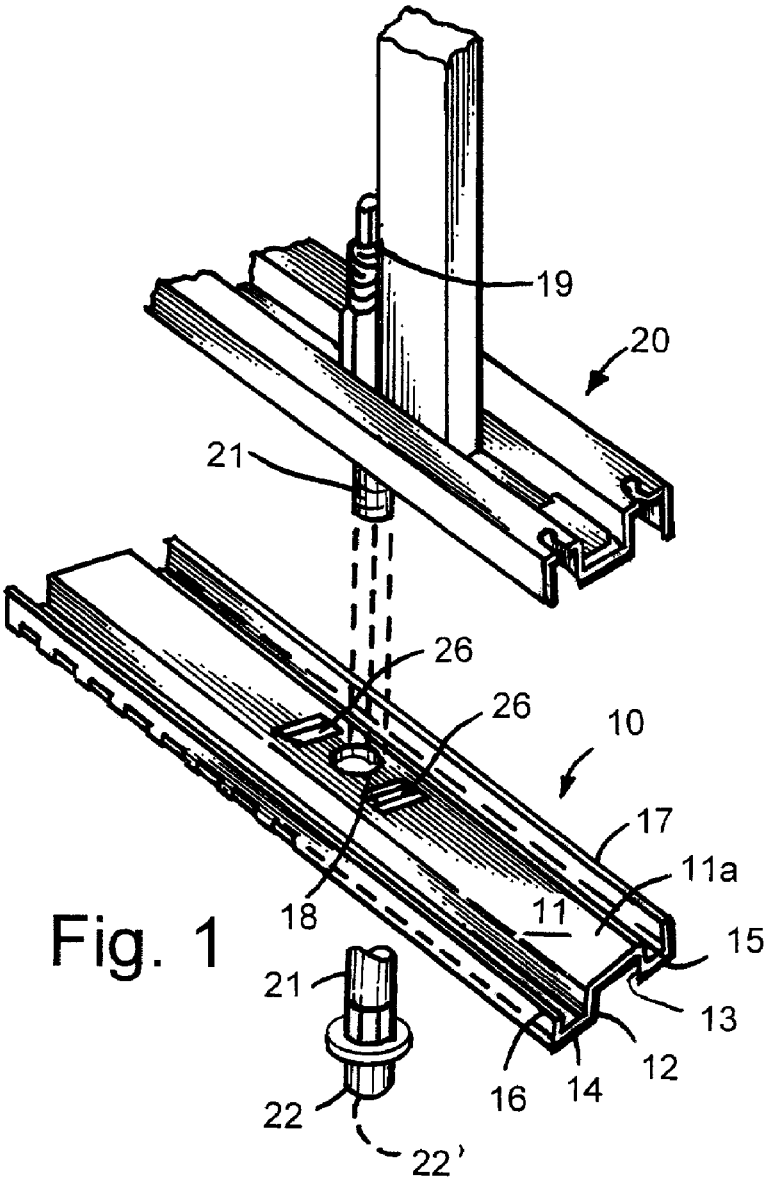
FIG. 1 is a fragmentary perspective view of a partition system embodying the present invention with an exploded leveling glide.
Figure 4:
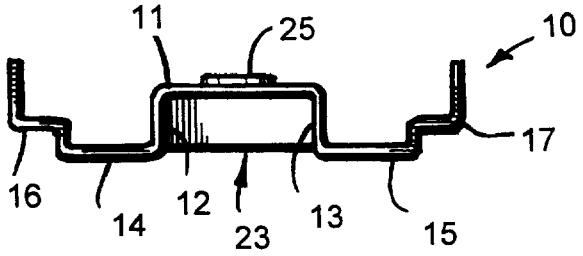
FIG. 4 is an end view of the floor channel and clip portions of the present invention.

As shown in FIG. 1, the present invention includes a floor channel 10 which includes a raised flange 11, having a flat top portion 11*a*. The raised flange 11 also includes two side walls 12 and 13, which project upwardly from two floor-engaging portions 14 and 15, respectively (see FIG. 4). Floor channel 10 also includes an outer flange 16 on its front side and outer flange 17 on its back side. Floor channel 10 has an aperture 18, which is preferably a round hole, in top portion 11*a* of flange 11. The shaft 21 of a leveling glide 19 fits through aperture 18 and into the leveling system of a partition system 20. The aperture 18 is preferably round to optimally distribute stress around the hole, such that the head and washer 22 of the leveling guide 19 does not pull through during a catastrophic event, such as an earthquake. Specifically, the shaft 21 of the leveling glide 19 is threaded to engage a similarly threaded portion of partition system 20. The leveling glide 19 and its engagement with the partition system is more fully described in commonly assigned U.S. Pat. No. 5,836,121, the disclosure of which is hereby incorporated in its entirety by reference.

Figure 6:
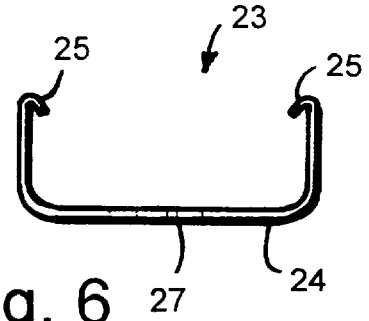
FIG. 6 is a front elevational view of the clip portion of the present invention.

As seen in FIGS. 3 and 6, the leveling glide 19 includes a head and washer 22 with a hex-shaped socket 22' so that the leveling glide 19 may be adjusted, by use of a tool such as an Allan wrench, through the bottom of floor channel 10 for adjustment of the height of the partition system. The other parts of the leveling glide are discussed in detail below.

Figure 2:
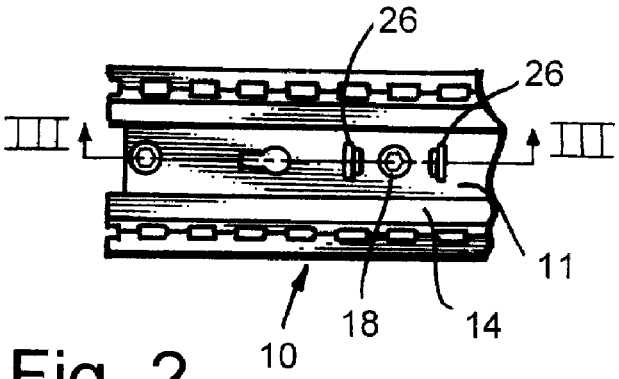
FIG. 2 is a top view of the floor channel and leveling glide portions of the present invention.
Figure 5:
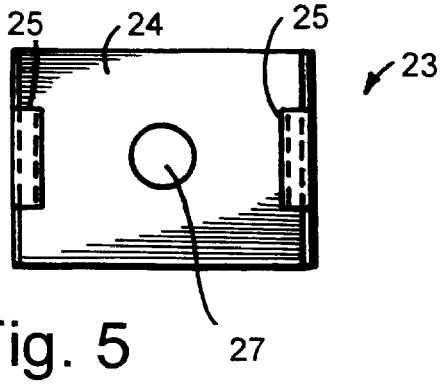
FIG. 5 is a top view of the clip portion of the present invention.

Leveling glide 19 is held in place in floor channel 10 by the use of a clip 23 (see FIG. 3). Clip 23 includes a bottom portion 24 and two snap-attach retainers 25. As shown in FIG. 5, retainers 25 are shorter than the overall width of clip 23. The depth (front to back dimension) of clip 23 is slightly less than the depth of raised flange 11. Clip 23 is shaped to fit into the space defined under raised flange 11 (see FIG. 4), with each of the retainer portions 25 of clip 23 fitting through a respective aperture 26 (see FIGS. 1 and 2) in the top portion 11*a* of the raised flange 11. During installation of clip 23, the retainers 25 flex outwardly to slip into the apertures 26, and then inwardly in secure frictional engagement. Clip 23 also includes an aperture (see FIG. 5), preferably a round hole 27. The hole 27 is preferably larger than the diameter of the hex-shaped portion of the head 22 of the leveling glide 19, but smaller than the overall diameter of the bottom of leveling glide 19 so that the clip, once positioned, will hold the leveling glide in place within the space defined by the raised flange portion 11 of the floor channel 10 (see FIGS. 3 and 4). Hole 27 allows access to the hex-shaped portion of the head 22 of leveling glide 19 from the underside of floor channel 10.

Figure 7:
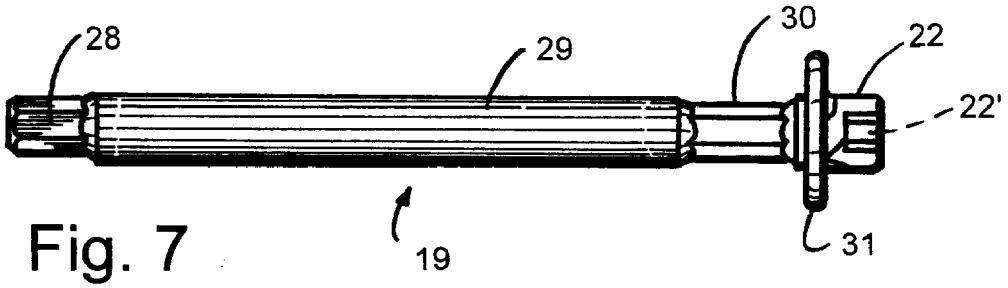
FIG. 7 is an elevational view of the leveling glide portion of the present invention.

As shown in FIG. 7, the leveling glide 19, in addition to head portion 22, includes an upper end section 28 that is hex shaped so that a socket tool or wrench may be used to rotate the leveling glide from above. Leveling glide 19 also has a shaft portion 29 most of which is threaded, but which also has a hex-shaped portion 30, that when in use is positioned above the raised flange portion 11 of floor channel 10 so that an open-ended wrench may be used from the side to rotate the leveling glide 19 and thereby adjust the height of the partition system. Leveling glide 19 also includes an integral washer 31 on the head 22 which has a diameter greater than the diameter of aperture 18 so that the leveling glide cannot be pulled through aperture 18.

For assembly, the upper end section 28 and shaft 29 of the leveling glide 19 are extended through aperture 18 in the raised flange portion 11 of the floor channel 10 until the washer portion 31 of tie leveling glide 19 abuts the underside of raised flange portion 11. Clip 23 is then snapped into place. Specifically, the clip 23 is moved upwardly under leveling glide 19 until it abuts the bottom of the head portion 22 of leveling glide 19. Retainer portions 25 of the clip are inserted through apertures 26 in the raised flange 11 until their ends are completely through the aperture and frictionally retained therein. The ends of retainers 25 engage the top 11*a* of raised flange 11 and thereby secure the clip and leveling glide 19 to the underside of the raised flange 11. When installed, the washer portion 31 of the leveling glide 19 assures that it will not be pulled through aperture 18. The threaded portion of the shaft 29 of the leveling glide 19 is engaged with the similarly threaded nut on the partition 20. To adjust the height of partition 20, any one of the hex-shaped portions 22', 30, and 28 of the head, the shaft, or the upper end section of the leveling glide 19 can be engaged with a tool such as an Allan wrench or socket wrench or open-ended wrench to rotate the leveling glide and to thereby raise or lower partition 20 relative to the floor surface.

The present invention provides a useful system for raising and lowering a partition system with few pieces while providing a very stable configuration that will not come loose or break down even in severe catastrophic events. The present invention also protects a building floor from abrasion that might occur by adjusting the leveling glide at high speeds with a power drill/driver. The leveling system further acts as a shock absorber to protect the floor channel while the system goes through tip-up and impact motions during staging and installation.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An apparatus comprising:

a floor channel having a floor-engaging flange and having a raised flange with an aperture therein;

a partition having a leveler assembly that includes a threaded leveling glide that can be rotated for adjusting the height of the partition relative to a floor surface, the leveling glide including a shaft extended through the aperture and further including a head positioned below the raised flange that is larger than the aperture such that the head cannot be pulled through the aperture and still further including an upper end section positioned above the floor channel;

the head, the shaft, and the upper end section each having non-circular cross sections shaped for engagement by tools for rotationally adjusting the leveling glide.

2. The apparatus defined in claim 1 and further including a clip attached to the floor channel and having a retainer section holding the head of the leveling glide to prevent the head from dropping below the floor-engaging flange.

3. The apparatus defined in claim 2 wherein the head of the leveling glide has a hex-shaped outer surface for engagement by a socket tool or wrench.

4. The apparatus defined in claim 3 wherein the shaft of the leveling glide has an intermediate section with a hex-shaped outer surface for engagement by a wrench.

5. The apparatus defined in claim 4 wherein the upper end section of the leveling glide has a hex-shaped outer surface for engagement by a socket tool or wrench.

6. The apparatus defined in claim 5 wherein the clip has a hole that aligns with the aperture in the floor channel and permits a tool to engage the head of the leveling glide while the clip is attached.

7. The apparatus defined in claim 6 wherein the aperture in the floor channel is a round hole.

8. The apparatus defined in claim 7 wherein the head of the leveling guide has washer portion that is larger than the round hole in the floor channel.

9. The apparatus defined in claim 1 wherein the head of the leveling glide has a hex-shaped outer surface for engagement by a socket tool or wrench.

10. The apparatus defined in claim 1 wherein the shaft of the leveling glide has an intermediate section with a hex-shaped outer surface for engagement by a wrench.

11. The apparatus defined in claim 1 wherein the upper end section of the leveling glide has a hex-shaped outer surface for engagement by a socket tool or wrench.

12. The apparatus defined in claim 2 wherein the clip has a hole that aligns with the aperture in the floor channel and permits a tool to engage the head of the leveling glide while the clip is attached.

13. The apparatus defined in claim 1 wherein the aperture in the floor channel is a round hole.

14. An apparatus comprising:

a floor channel having a floor-engaging flange and having a raised flange with an aperture therein;

a partition having a leveler assembly that includes a leveling glide that can be adjusted to change the height of the partition relative to a floor surface, the leveling glide including a shaft extended through the aperture and further including a head positioned below the raised flange that is larger than the aperture such that the head cannot be pulled through the aperture; and a clip attached to the floor channel below the raised flange with a retainer section that abuts the head and prevents the head from dropping below the floor-engaging flange.

15. The apparatus defined in claim 14 wherein the shaft of the leveling glide includes a hex-shaped outer surface for engagement by a wrench.

16. The apparatus defined in claim 15 wherein the head of the leveling glide includes a hex-shaped portion, presenting a second hex-shaped outer surface to the leveling glide for engagement by a socket tool or wrench.

17. The apparatus defined in claim 16 wherein the leveling glide includes an upper end portion having a hex-shaped portion, presenting a third hex-shaped outer surface to the leveling glide for engagement by a socket tool or wrench.

18. The apparatus defined in claim 17 wherein the clip has a hole that aligns with the aperture in the floor channel and permits a tool to engage the head of the leveling glide while the clip is attached.

19. The apparatus defined in claim 18 wherein the aperture in the floor channel is a round hole.

20. The apparatus defined in claim 19 wherein the head of the leveling guide has washer portion that is larger than the round hole in the floor channel.

21. The apparatus defined in claim 14 wherein the aperture in the floor channel is a round hole.

22. The apparatus defined in claim 21 wherein the head of the leveling guide has a washer portion that is larger than the round hole in the floor channel.

23. A method comprising the steps of:

(a) providing a floor channel having a floor-engaging flange and having a raised flange with an aperture therein;

(b) providing a partition having a leveler assembly that includes a threaded leveling glide, the leveling glide including a shaft extended through the aperture and further including a head positioned below the raised flange that is larger than the aperture such that the head cannot be pulled through the aperture, and still further including an upper end section positioned above the floor channel; the shaft, the head, and the upper end section each having cross sections shaped for engagement by tools for rotationally adjusting the leveling glide; and (c) selectively engaging one of the shaft, the head, or the upper end section of the leveling guide with a tool to adjust the height of a partition relative to the floor surface.

24. The method defined in claim 23 and further including, before the step of selectively engaging one of the shaft, the head, or the upper end section, the step of providing a clip substantially below the raised flange, attached to the floor channel, and abutting the head to prevent the head from dropping below the floor-engaging flange.

* * * * *